US009926714B2

(12) United States Patent
Cusic

(10) Patent No.: US 9,926,714 B2
(45) Date of Patent: Mar. 27, 2018

(54) STORAGE BASKET

(71) Applicant: Rhonda Cusic, Diamond Springs, CA (US)

(72) Inventor: Rhonda Cusic, Diamond Springs, CA (US)

( * ) Notice: Subject to any disclaimer, the term of this patent is extended or adjusted under 35 U.S.C. 154(b) by 0 days.

(21) Appl. No.: 15/350,383

(22) Filed: Nov. 14, 2016

(65) Prior Publication Data

US 2017/0130478 A1 May 11, 2017

Related U.S. Application Data

(60) Provisional application No. 62/253,769, filed on Nov. 11, 2015.

(51) Int. Cl.
*B65D 33/06* (2006.01)
*E04H 4/14* (2006.01)

(52) U.S. Cl.
CPC ..... *E04H 4/14* (2013.01)

(58) Field of Classification Search
CPC ..... E04H 4/14; A47G 25/0614
USPC ..... 383/12, 22, 23, 117; 248/99–101; 211/119.004, 119.006, 119.007, 119.009
See application file for complete search history.

(56) References Cited

U.S. PATENT DOCUMENTS 608,523 A * 8/1898 Lucas ..... A47D 9/00 211/119.006
1,151,699 A * 8/1915 McBride ..... A01K 97/04 224/406
1,284,579 A * 11/1918 Brown ..... B65D 7/20 220/482
2,260,352 A * 10/1941 Trapani ..... A47C 7/425 297/230.11
2,638,952 A * 5/1953 Sanderson ..... A47L 13/58 220/9.2
4,893,363 A 1/1990 Huff
5,118,059 A 6/1992 Mainer
5,705,058 A * 1/1998 Fischer ..... E04H 4/1609 210/237
6,306,295 B1 * 10/2001 Giacalone ..... E04H 4/14 210/167.2
6,913,385 B1 * 7/2005 Sagos ..... E04H 4/0018 383/23
7,661,635 B2 * 2/2010 McConnell ..... B65B 67/1227 141/316
7,802,709 B1 * 9/2010 Lewis ..... B60R 9/00 224/401

(Continued)

*Primary Examiner* — Jes F Pascua
(74) *Attorney, Agent, or Firm* — Global Intellectual Property Agency, LLC; Jordan Sworen

(57) ABSTRACT

A storage basket. The storage basket includes a pair of rods positioned parallel to one another, a hook disposed on the upper end of each of the pair of rods, a spacer disposed on the lower end of each of the pair of rods, a first cross-bar connecting each of the pair of rods, an extension member disposed on each of the pair of rods, and a second cross-bar connecting each of the extension rods to one another. The first cross bar, the extension rods, and the second cross-bar define an opening. A net is secured to the opening and extends downward toward the lower ends of the pair of rods, wherein the net and the opening define an open interior volume. The storage basket is securable to the outer side of a swimming pool and may be used to store various swimming pool rafts, toys, and other accessories.

6 Claims, 2 Drawing Sheets

(56) References Cited

U.S. PATENT DOCUMENTS

| | | | | |
|---|---|---|---|---|
| 8,025,172 | B1 | 9/2011 | Zink | |
| 8,448,268 | B2 * | 5/2013 | Bradshaw | E04H 4/14 211/100 |
| 8,490,811 | B2 * | 7/2013 | Erlich | A45C 7/0077 220/9.2 |
| 8,783,765 | B1 | 7/2014 | Matus et al. | |
| 9,212,497 | B2 * | 12/2015 | Chlapaty | E04H 4/14 |
| 2005/0167551 | A1 | 8/2005 | Leroux | |

* cited by examiner

STORAGE BASKET

CROSS REFERENCE TO RELATED APPLICATIONS

This application claims the benefit of U.S. Provisional Application No. 62/253,769 filed on Nov. 11, 2015. The above identified patent application is herein incorporated by reference in its entirety to provide continuity of disclosure.

FIELD OF THE INVENTION

The present invention relates to storage baskets. More specifically, the present invention provides a storage basket that is securable to a swimming pool and is configured to store swimming pool toys and accessories therein.

BACKGROUND OF THE INVENTION

Many individuals have a swimming pool for recreational purposes. These individuals often utilize a variety of pool toys and accessories such as inflatable rafts, beach balls, and the like. Pool accessories and toys often vary in size and can be rather large and irregularly shaped. This makes storing the accessories difficult. When pool toys and accessories are left out on the ground or deck surrounding the swimming pool, they create a tripping hazard for individuals near the swimming pool. Due to their size, individuals may need to store the pool accessories in a location removed from the swimming pool itself, such as a storage shed, so that they must be transported to the swimming pool when used. It can be difficult and time consuming to transport a large, cumbersome pool accessory such as an inflatable raft. It is therefore desirable to provide a storage basket that is securable to the edge of a swimming pool in order to store pool accessories such as rafts in close proximity to the swimming pool.

SUMMARY OF THE INVENTION

In view of the foregoing disadvantages inherent in the known types of storage baskets now present in the prior art, the present invention provides a storage basket wherein the same can be utilized for providing convenience for the user when storing swimming pool rafts, toys, and other accessories.

The storage basket includes a pair of rods positioned parallel to one another, each of the pair of rods having an upper end and a lower end. A hook is disposed on the upper end of each of the pair of rods. A spacer is disposed on the lower end of each of the pair of rods. A first cross-bar connects each of the pair of rods to one another. An extension member is disposed on each of the pair of rods, wherein each of the extension members extend perpendicularly from each of the pair of rods. A second cross-bar connects each of the extension rods to one another. The first cross bar, the extension rods, and the second cross-bar defining an opening. A net is secured to the opening and extends downward toward the lower ends of the pair of rods. The net and the opening define an open interior volume.

One object of the present invention is to provide a storage basket configured to store various pool accessories such as inflatable rafts, tubes, balls, pool noodles, and the like.

Another object of the present invention is to provide a storage basket for storing swimming pool accessories that is securable to the side of an above-ground swimming pool.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
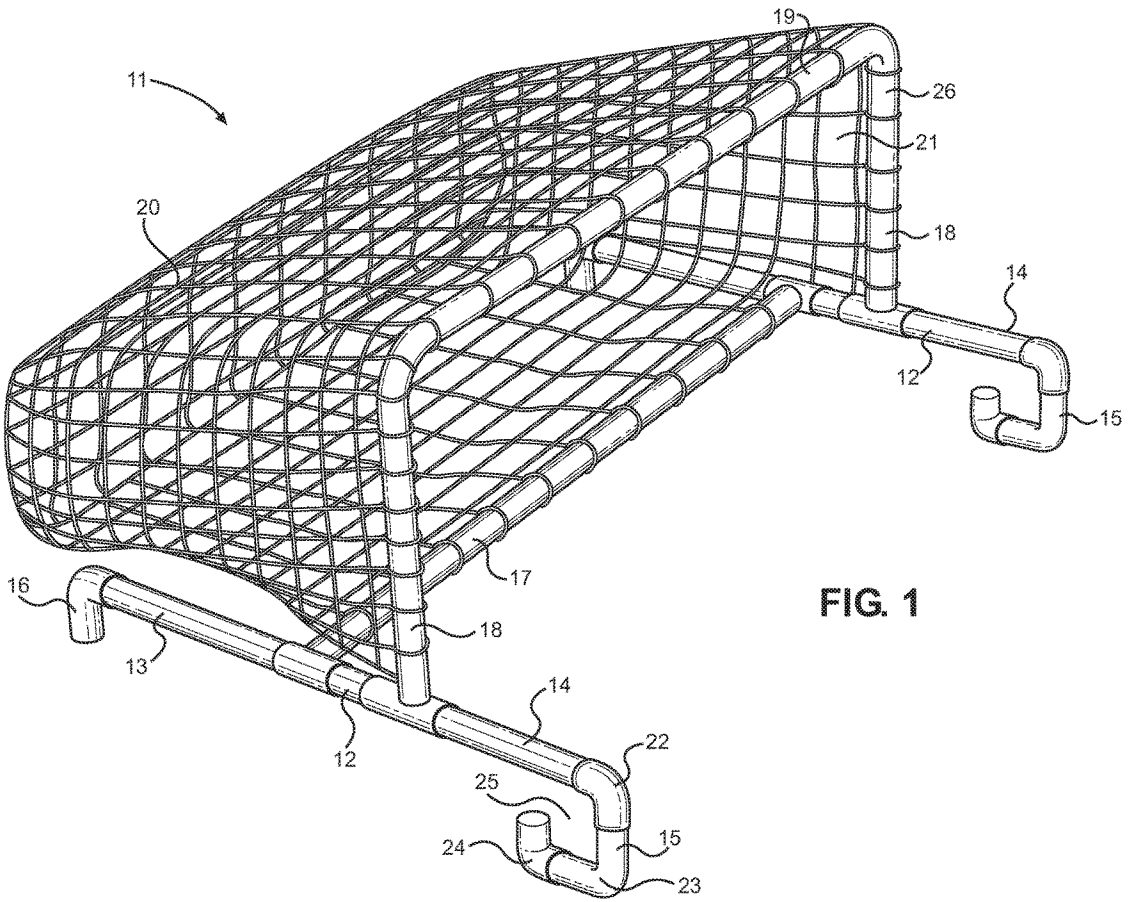
FIG. 1 shows a perspective view of a storage basket according to the present invention.

Reference is made herein to the attached drawings. Like reference numerals are used throughout the drawings to depict like or similar elements of the storage basket. For the purposes of presenting a brief and clear description of the present invention, the preferred embodiment will be discussed as used for storing swimming pool toys and accessories. The figures are intended for representative purposes only and should not be considered to be limiting in any respect.

Referring now to FIG. 1, there is shown a perspective view of a storage basket according to the present invention. The storage basket 11 generally comprises a pair of rods 12 positioned parallel to one another. Each rod 12 has a lower end 13 and an upper end 14. A first crossbar 17 positioned toward the lower end 13 of the rods 12 connects the rods 12 to one another. An extension member 18 is disposed on each rod 12 toward the upper end 14 thereof. Each extension member 18 extends perpendicularly from its respective rod 12. A second cross-bar 19 is disposed between each extension member 18.

The first cross bar 17, the second cross bar 19, and the extension members 18 define an opening 26. A net 20 is secured to perimeter of the opening 26 defined by the first cross bar 17, the second cross bar 19, and the extension members 18. The net 20 extends downward toward the lower end 13 of each of the rods 12. The opening 26 and the net 20 define an open interior volume 21. Individuals may store pool accessories such as inflatable rafts, balls, and the like within the open interior volume 21.

A hook 15 is disposed on the upper end 14 of each rod 12. The hooks 15 secure the storage basket 11 to the side of an above-ground pool. A spacer 16 is disposed on the lower end 13 of each rod 12. In the illustrated embodiment, each spacer 16 is perpendicular to each rod 12, and each spacer 16 extends in a direction opposing each extension member 18. In the illustrated embodiment, the rods 12, first crossbar 17, second crossbar 19, spacers 16, and hooks 15 comprise a circular cross section. However, each of the above mentioned elements may comprise a rectangular cross-section The hooks 15 include a first elbow 22 extending in a direction opposing the extension members 18, a second elbow 23 connected to the first elbow 22 extending toward the lower end 13 of each rod 12, and a third elbow 24 connected to the second elbow 23 extending in the same direction as the extension members 18. The first elbow 22, second elbow 23, and third elbow 24 define a hook opening

25. The hook opening 25 receives the edge of an above-ground pool in order to support the storage basket 11 thereon.

Figure 2:
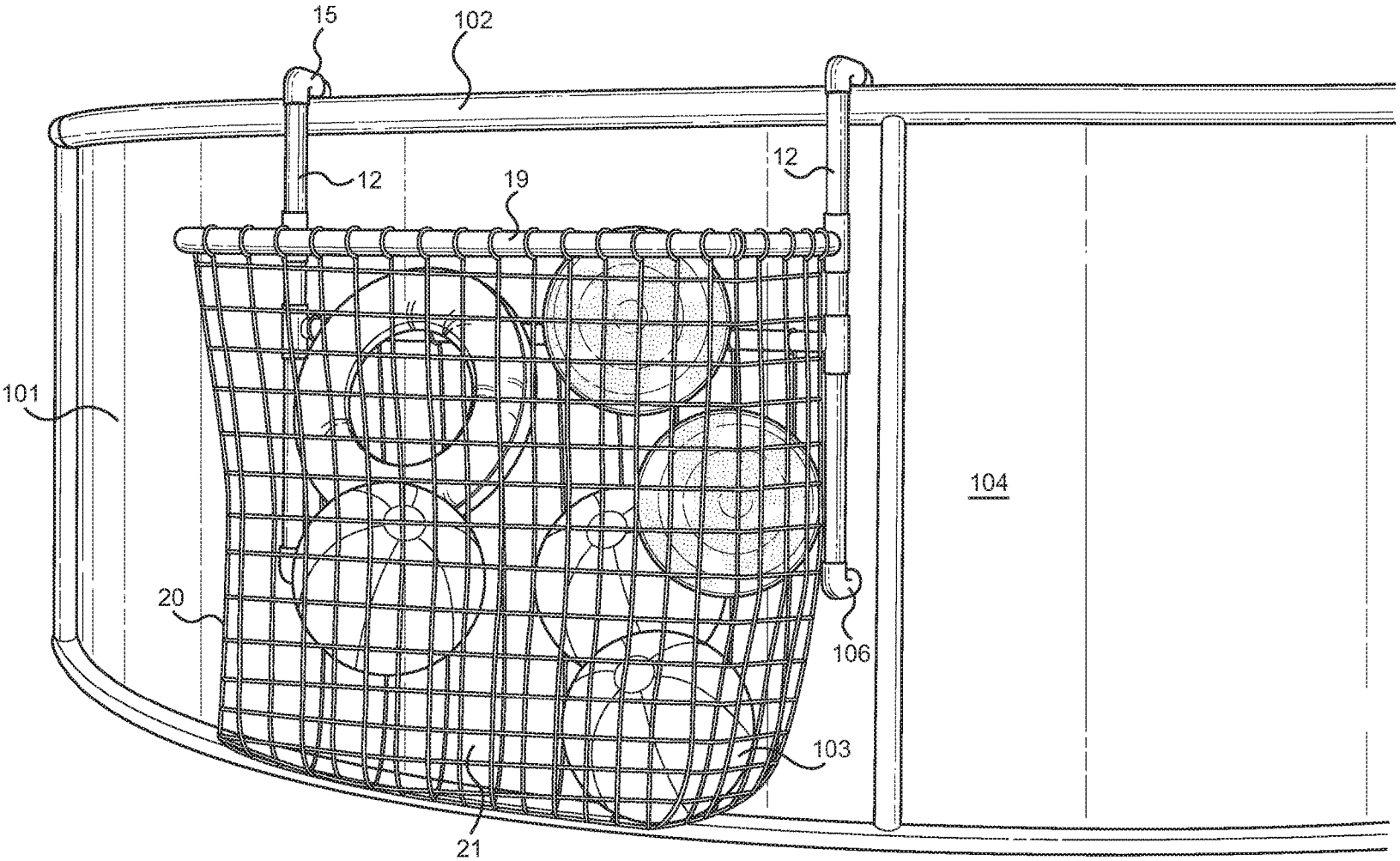
FIG. 2 shows a perspective view of a storage basket according to the present invention in use.

Referring now to FIG. 2, there is shown a perspective view of a storage basket according to the present invention in use. The storage basket is secured to a sidewall 101 of an above-ground swimming pool. The hooks 15 support the storage basket on an upper edge 102 of the swimming pool sidewall 101. The net 20 hangs downward toward the bottom of the swimming pool sidewall 101. A variety of pool accessories 103 are stored within the open interior volume 21 defined by the net 20. The open upper end of the net 20 allows for quick and easy retrieval of pool accessories 103 by individuals occupying the swimming pool, or those standing just outside of it.

The spacers 106 prevent the rods 12 from contacting the outer surface 104 of the pool sidewall 101 along their entire length in order to prevent the rods 12 from wearing or damaging the pool sidewall 101. In other words, the hooks 15 support the storage basket on the upper edge 102 of the pool sidewall 101 and the spacers 106 support the storage basket against the outer surface 104 of the pool sidewall 101. Additionally, the storage basket is preferably composed of durable waterproof and rustproof materials such as PVC piping. This allows the storage basket to maintain its structural integrity even after getting wet due to its proximity to the water in the swimming pool. The storage basket therefore provides a space for storing pool accessories that is easily accessible for occupants of the swimming pool.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage basket comprising:

a pair of rods positioned parallel to one another, each of the pair of rods comprising an upper end and a lower end;

a hook disposed on the upper end of each of the pair of rods;

a spacer disposed on the lower end of each of the pair of rods;

a first cross-bar connecting each of the pair of rods to one another;

an extension member disposed on each of the pair of rods, each of the extension members extending perpendicularly from each of the pair of rods, each extension member positioned on each rod between the hook of each rod and a connection point of the first crossbar on each rod;

a second cross-bar connecting each of the extension members to one another, wherein the first cross bar, the extension members, and the second cross-bar define an opening;

a net secured to the opening and extending downward toward the lower ends of the pair of rods, the net including a front wall, a rear wall, a pair of sidewalls, a closed lower end, and an open upper end coextensive with the opening, wherein the open upper end of the net and the opening define an open interior volume;

wherein the first crossbar is connected to each rod between the spacer and the extension member of each rod.

2. The storage basket of claim 1, wherein each spacer is perpendicular to each of the pair of rods and extends in a direction opposing each of the extension members.

3. The storage basket of claim 1, wherein each hook comprises:

a first elbow extending in a direction opposing the extension members;

a second elbow extending toward the lower end of the pair of rods; and a third elbow extending in a direction that is the same orientation as the extension member;

wherein the first elbow, second elbow, and third elbow define an open loop;

wherein the open loop is configured to receive an upper edge of a swimming pool sidewall therein in order to support the hook thereon.

4. The storage basket of claim 1, wherein the spacers are configured to contact an outer side of a swimming pool when the hooks are supported by an upper edge of the swimming pool sidewall.

5. The storage basket of claim 1, wherein a lower end of the net extends past the lower end of each of the pair of rods.

6. The storage basket of claim 1, wherein each of the pair of rods, hook, spacer, first cross-bar, extension member, and second-cross bar are composed of PVC.

* * * * *